US011035208B2

(12) United States Patent
Penno et al.

(10) Patent No.: US 11,035,208 B2
(45) Date of Patent: Jun. 15, 2021

(54) SINGLE TRIP DUAL ZONE SELECTIVE GRAVEL PACK

(71) Applicant: Halliburton Energy Services, Inc., Houston, TX (US)

(72) Inventors: Andrew Penno, Sentosa (SG); Jean-Michel Alain Ranjeva, Perth (AU); Simon White, East Victoria Park (AU)

(73) Assignee: Halliburton Energy Services, Inc., Houston, TX (US)

( * ) Notice: Subject to any disclaimer, the term of this patent is extended or adjusted under 35 U.S.C. 154(b) by 146 days.

(21) Appl. No.: 16/295,068

(22) Filed: Mar. 7, 2019

(65) Prior Publication Data

US 2019/0292885 A1 Sep. 26, 2019

Related U.S. Application Data

(60) Provisional application No. 62/646,310, filed on Mar. 21, 2018.

(51) Int. Cl.

| | |
|---|---|
| ***E21B 43/04*** | (2006.01) |
| ***E21B 43/14*** | (2006.01) |
| ***E21B 43/08*** | (2006.01) |
| ***E21B 34/10*** | (2006.01) |
| ***E21B 33/126*** | (2006.01) |

(52) U.S. Cl.

CPC ..... *E21B 43/045* (2013.01); *E21B 33/126* (2013.01); *E21B 34/10* (2013.01); *E21B 43/08* (2013.01); *E21B 2200/06* (2020.05)

(58) Field of Classification Search

CPC ..... E21B 43/04; E21B 43/045; E21B 43/14

See application file for complete search history.

(56) References Cited

U.S. PATENT DOCUMENTS

| | | | | |
|---|---|---|---|---|
| 7,918,276 | B2 * | 4/2011 | Guignard | E21B 43/04 166/278 |
| 8,770,290 | B2 * | 7/2014 | van Petegem | E21B 43/08 166/278 |
| 9,260,950 | B2 * | 2/2016 | Broussard | E21B 34/102 |
| 9,447,661 | B2 * | 9/2016 | Broussard | E21B 43/045 |
| 10,145,219 | B2 * | 12/2018 | Bourgneuf | E21B 33/12 |
| 10,704,360 | B2 * | 7/2020 | Poluchalla | E21B 34/10 |
| 2007/0114043 | A1 | 5/2007 | Richards et al. | |

* cited by examiner

*Primary Examiner* — Kenneth L Thompson

(74) *Attorney, Agent, or Firm* — Scott Richardson; Parker Justiss, P.C.

(57) ABSTRACT

Provided is method for gravel packing dual zones within a wellbore and integrating a zonal isolation system. The method, in one embodiment, includes creating an outer sub-assembly and an inner sub-assembly, wherein the inner sub-assembly is positioned within the outer sub-assembly. The method further includes running the outer sub-assembly proximate a bottom of a downhole portion of a wellbore, and setting an uphole packer in an uphole portion of the wellbore and a downhole packer in the downhole portion of the wellbore. The method further includes gravel packing an upper zone and a lower zone, pulling the gravel pack service tool assembly out of the wellbore thereby isolating the upper zone and the lower zone from each other and the wellbore, and running an upper completion into the wellbore to open one or both of the upper zone or the lower zone for production.

20 Claims, 8 Drawing Sheets

SINGLE TRIP DUAL ZONE SELECTIVE GRAVEL PACK

CROSS-REFERENCE TO RELATED APPLICATION

This application claims the benefit of U.S. Provisional Application Ser. No. 62/646,310 filed on Mar. 21, 2018 entitled "SINGLE TRIP DUAL ZONE SELECTIVE OPEN HOLE HORIZONTAL GRAVEL PACK," commonly assigned with this application and incorporated herein by reference.

BACKGROUND

It is well known in the subterranean well drilling and completion art that particulate materials such as sand may be produced during the production of hydrocarbons from a well traversing an unconsolidated or loosely consolidated subterranean formation. Numerous problems may occur as a result of the production of such particulate. For example, the particulate causes abrasive wear to components within the well, such as tubing, pumps and valves. In addition, the particulate may partially or fully clog the well creating the need for an expensive workover. Also, if the particulate matter is produced to the surface, it must be removed from the hydrocarbon fluids by processing equipment at the surface.

One method for preventing the production of such particulate material to the surface is gravel packing the well adjacent the unconsolidated or loosely consolidated production interval. In a typical gravel pack completion, a completion string including a packer, a circulation valve, a fluid loss control device and one or more sand control screens is lowered into the wellbore to a position proximate the desired production interval. A service tool is then positioned within the completion string and a fluid slurry including a liquid carrier and a particulate material known as gravel is then pumped through the circulation valve into the well annulus formed between the sand control screens and the perforated well casing or open hole production zone.

The liquid carrier either flows into the formation or returns to the surface by flowing through the sand control screens or both. In either case, the gravel is deposited around the sand control screens to form a gravel pack, which is highly permeable to the flow of hydrocarbon fluids but blocks the flow of the particulate carried in the hydrocarbon fluids. As such, gravel packs can successfully prevent the problems associated with the production of particulate materials from the formation.

During such gravel packing operations, multiple trips into and out of the well are typically required to gravel pack the different zones therein. Unfortunately, tripping into the well and out of the well can be quite costly. What is needed in the art are gravel pack tools and/or methodologies that reduce the number of trips into and out of the well to gravel pack the different zones therein, and advantageously isolate the different gravel packed zones from each other to avoid crossflow.

BRIEF DESCRIPTION

Figure 1:
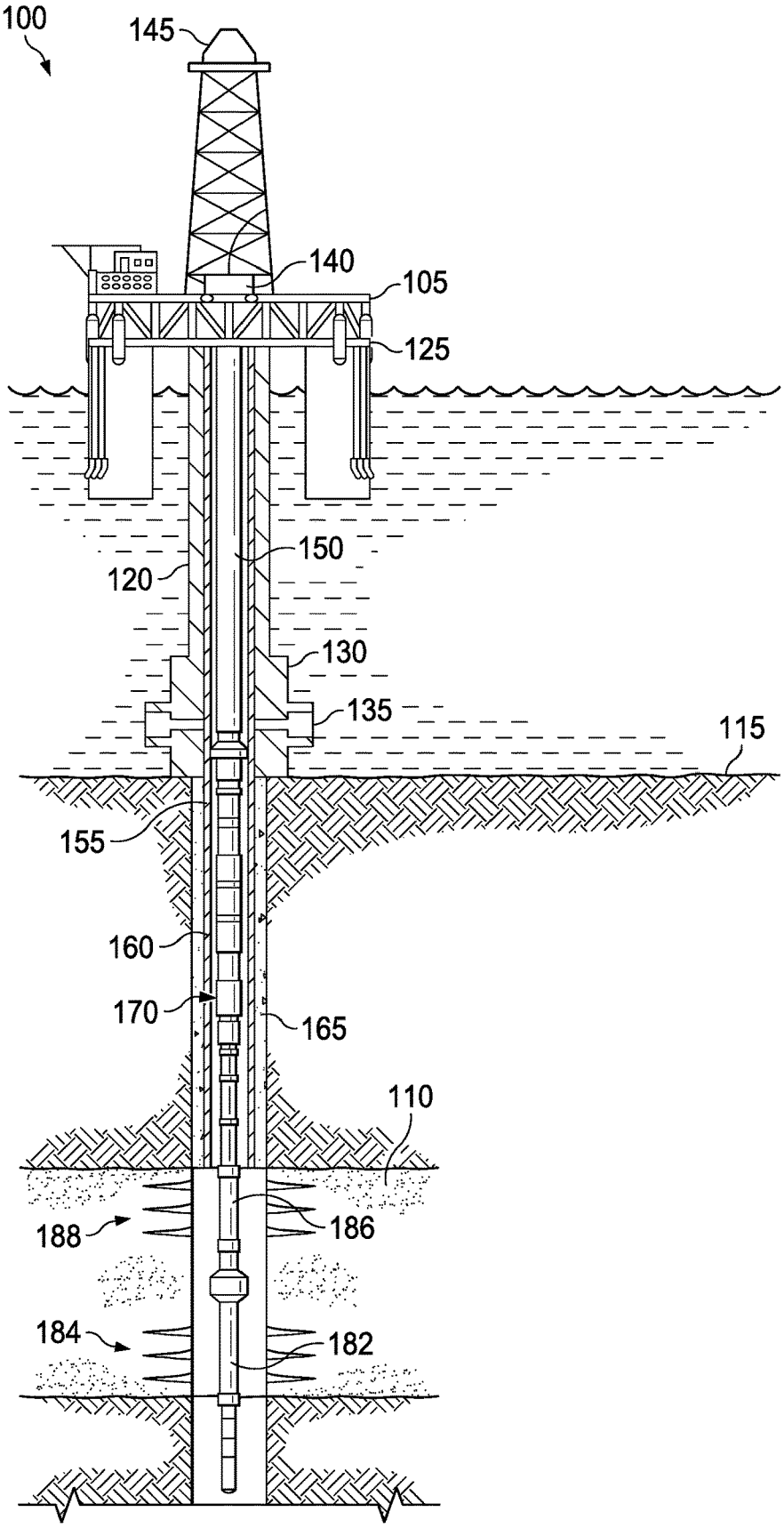
Figure 2A:
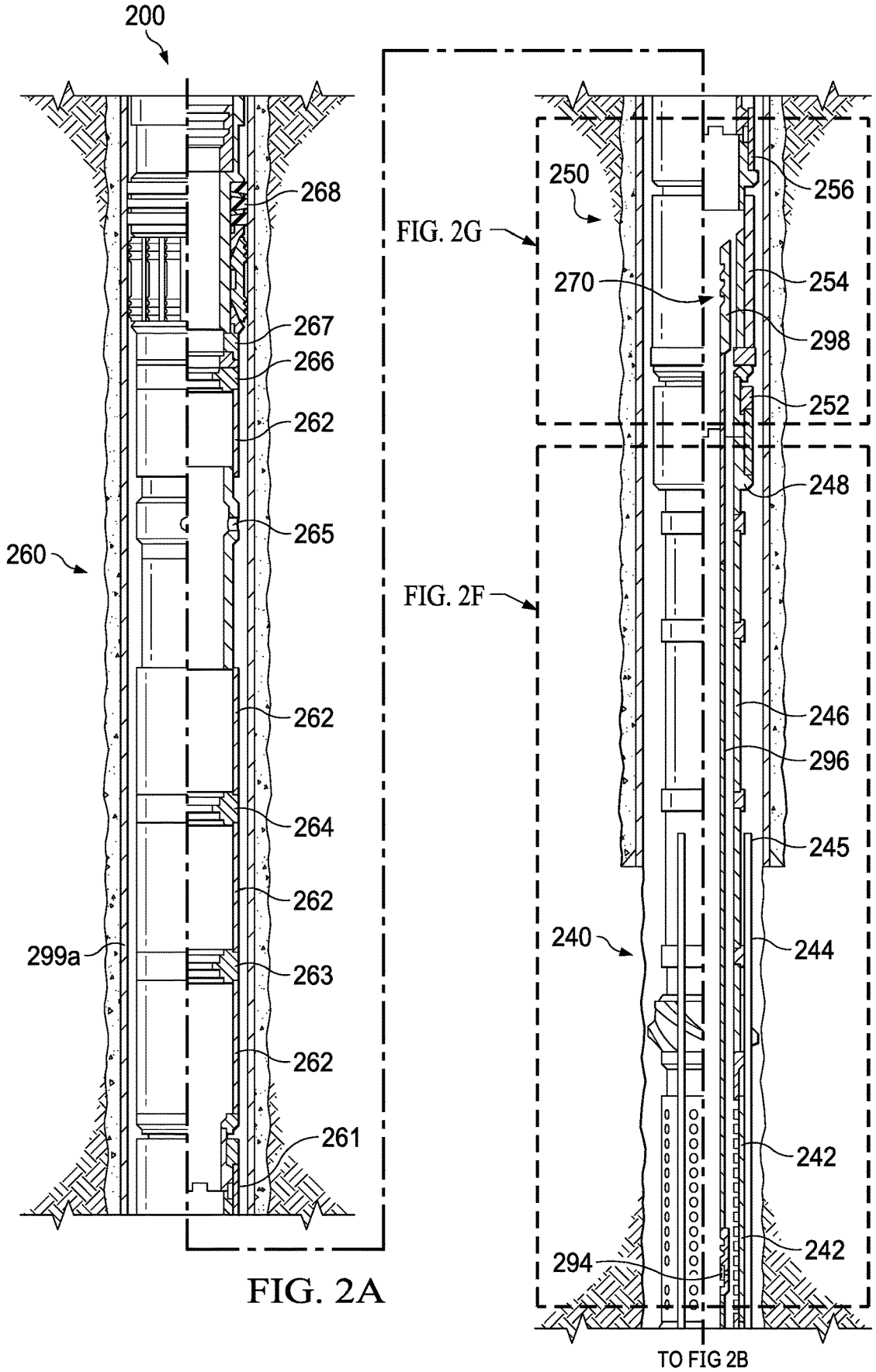
Figure 2B:
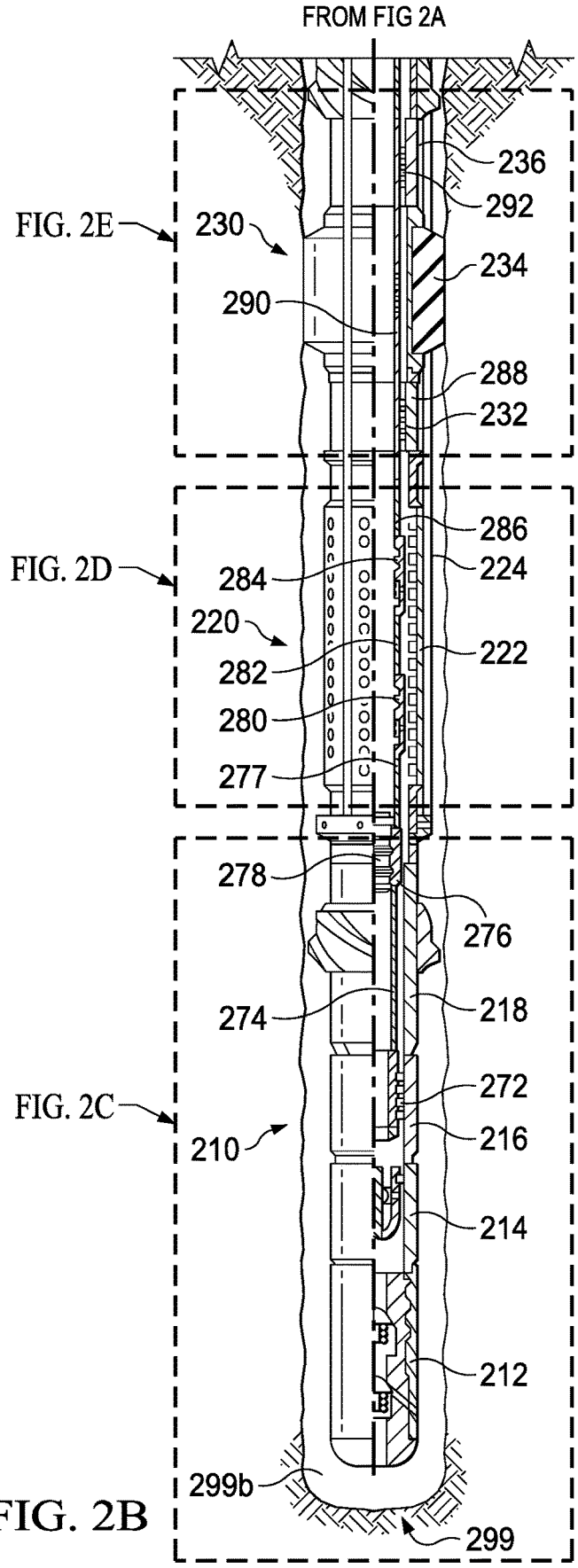
Figure 2C:
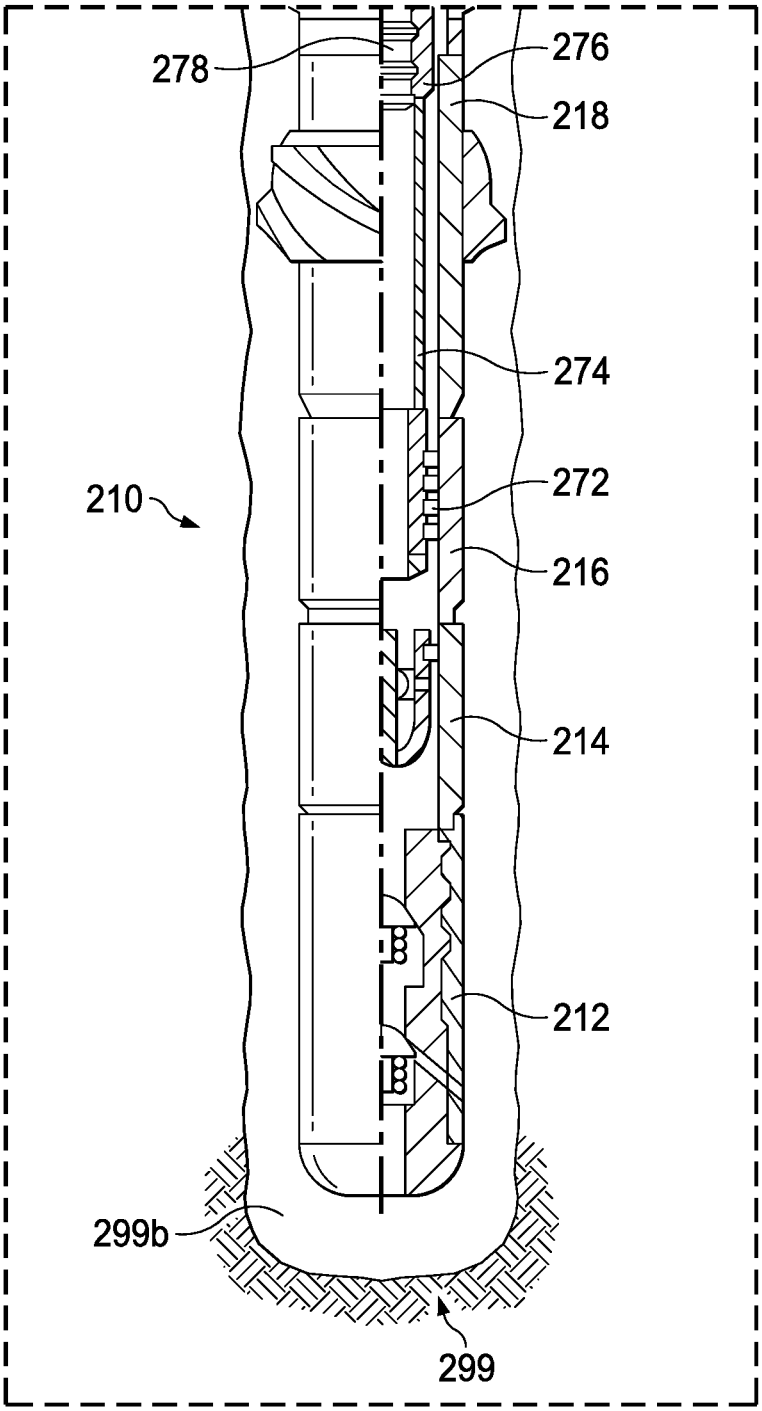
Figure 2D:
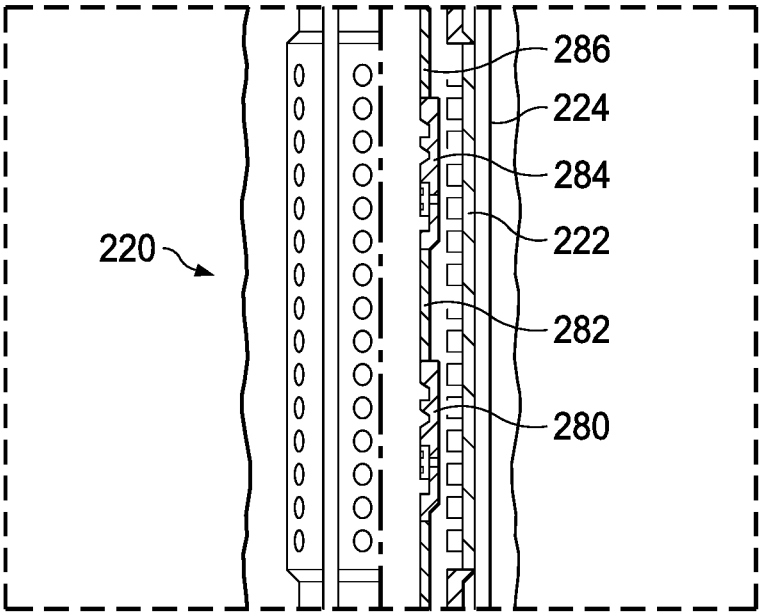
Figure 2E:
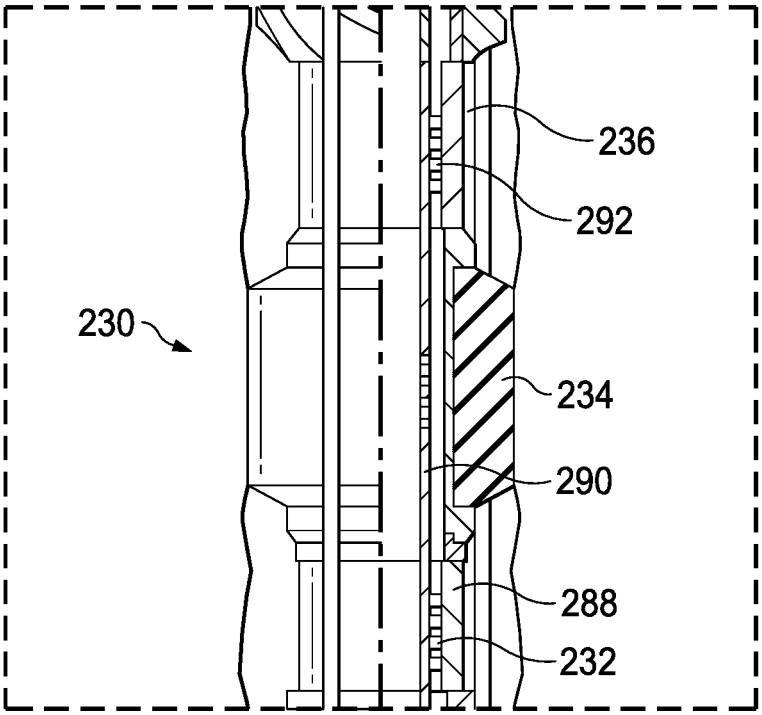
Figure 2F:
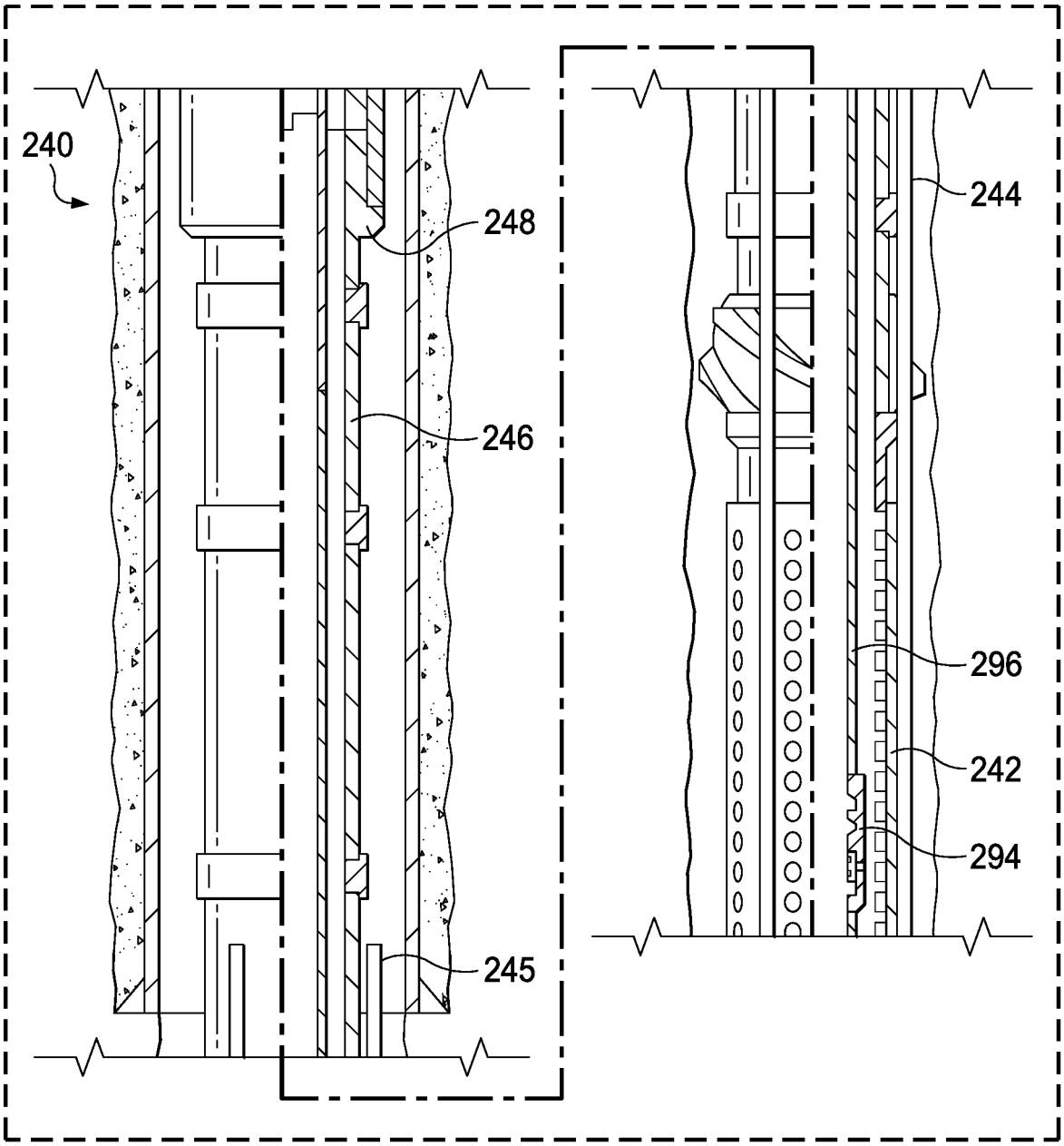
Figure 2G:
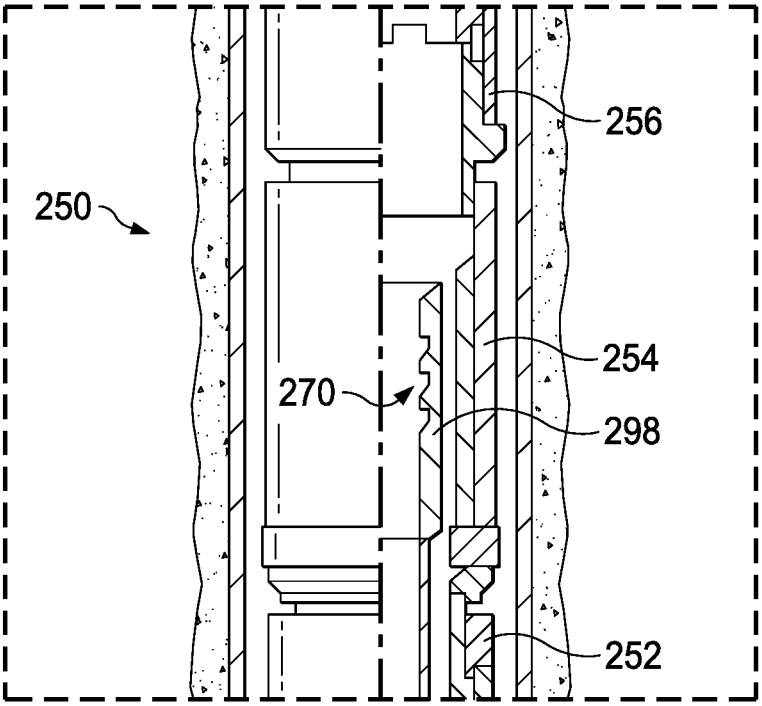
Figure 3:
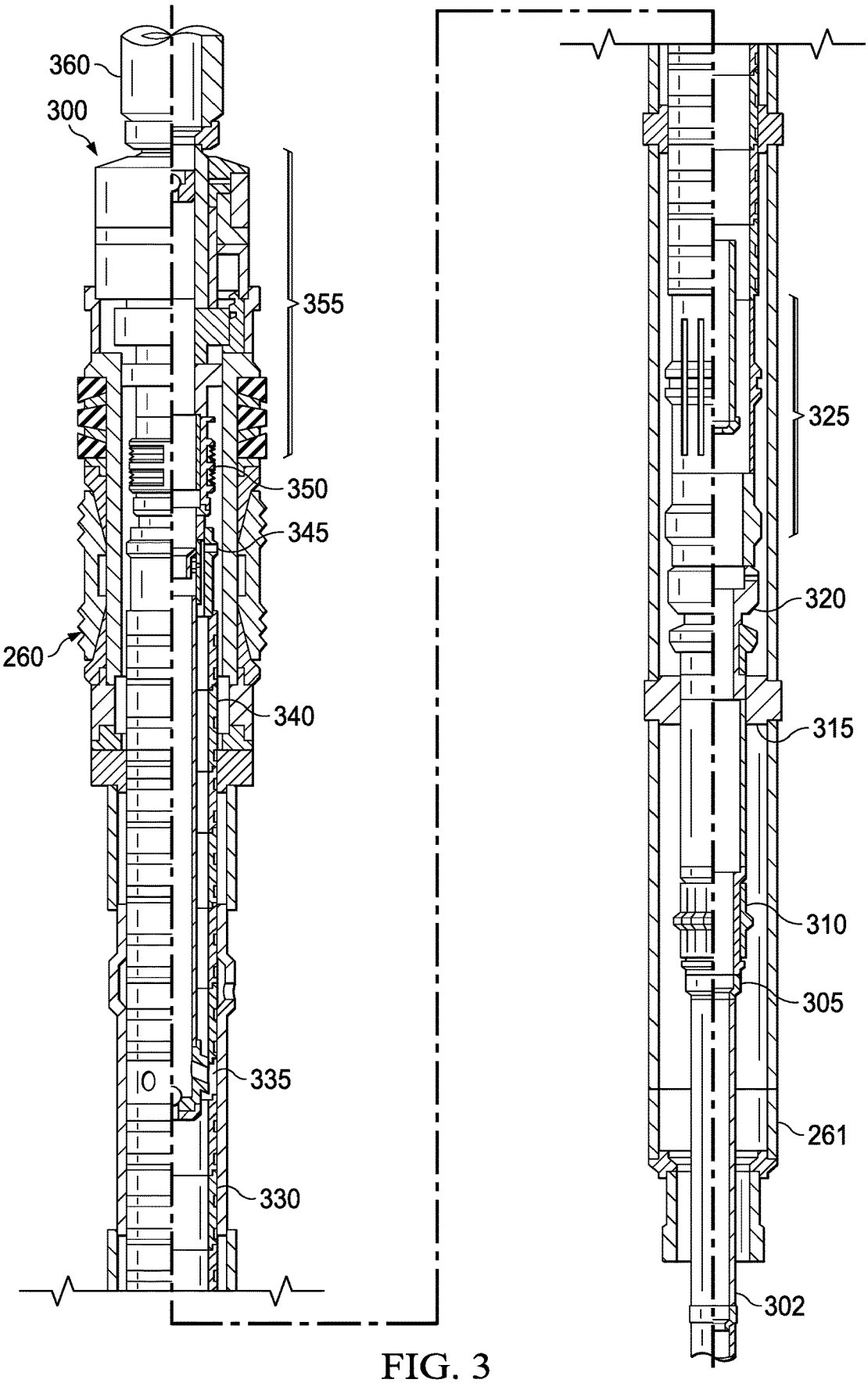

Reference is now made to the following descriptions taken in conjunction with the accompanying drawings, in which:

FIG. 1 illustrates one embodiment of a lower completion assembly being lowered into a well from an oil and gas platform;

FIGS. 2A and 2B, as well as the enlarged views of FIGS. 2C-2G, illustrate one embodiment of a lower completion assembly as might remain within a an uphole portion and a downhole portion of a wellbore after completing a dual zone gravel pack process according to the disclosure; and FIG. 3 illustrates a gravel pack service tool assembly according to the present disclosure.

DETAILED DESCRIPTION

In the drawings and descriptions that follow, like parts are typically marked throughout the specification and drawings with the same reference numerals, respectively. The drawn figures are not necessarily to scale. Certain features of the disclosure may be shown exaggerated in scale or in somewhat schematic form and some details of certain elements may not be shown in the interest of clarity and conciseness. The present disclosure may be implemented in embodiments of different forms.

Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed herein may be employed separately or in any suitable combination to produce desired results.

Unless otherwise specified, use of the terms "connect," "engage," "couple," "attach," or any other like term describing an interaction between elements is not meant to limit the interaction to direct interaction between the elements and may also include indirect interaction between the elements described.

Unless otherwise specified, use of the terms "up," "upper," "upward," "uphole," "upstream," or other like terms shall be construed as generally toward the surface of the ground; likewise, use of the terms "down," "lower," "downward," "downhole," or other like terms shall be construed as generally toward the bottom, terminal end of a well, regardless of the wellbore orientation. Use of any one or more of the foregoing terms shall not be construed as denoting positions along a perfectly vertical axis. Unless otherwise specified, use of the term "subterranean formation" shall be construed as encompassing both areas below exposed earth and areas below earth covered by water such as ocean or fresh water.

Referring initially to FIG. 1, a lower completion assembly according to one embodiment of the present disclosure is being lowered into a well from an oil and gas platform, which is schematically illustrated and generally designated 100. In the embodiment of FIG. 1, a semi-submersible platform 105 is positioned over a subterranean formation 110 located below sea floor 115. A subsea conduit 120 extends from deck 125 of platform 105 to wellhead installation 130 including blowout preventers 135. Platform 105 has a hoisting apparatus 140, which may include a rotary table, and a derrick 145 for raising and lowering pipe strings such as work string 150.

A wellbore 155 extends through the various earth strata including subterranean formation 110. A casing 160 is cemented within wellbore 155 by cement 165. A lower completion assembly 170 has been run within casing 160. The lower completion assembly 170, in accordance with one embodiment of the disclosure, is a dual zone selective gravel pack assembly. When it is desired to gravel pack the annular region 182 around the first (e.g., lower) zone 184, and the annular region 186 around the second (e.g., upper) zone 188, the lower completion assembly 170 is lowered through the casing 160 to the appropriate position within the subterranean formation 110. Once the lower completion assembly is appropriately positioned, it may be run through its various positions to assure proper operation thereof. Thereafter, a fluid slurry including a liquid carrier and a particulate material such as sand, gravel or proppants is pumped down work string 150. The fluid slurry is pumped down the work string 150 until the annular region 182 around the first zone 184, and the annular region 186 around the second zone 188, are filled with gravel.

After the lower completion assembly 170 has been used to gravel pack the first and second zones 184, 188, a service tool and service washpipe (e.g., feature 302 in FIG. 3) located within the lower completion assembly 170 may be pulled out of hole ("POOH"). In the process of pulling the service tool out of hole, an isolation plug of the lower completion assembly 170 may be set, a sliding sleeve in the first zone 184 may be closed, and a sliding sleeve in the second zone 188 may be closed. At this stage, the first and second zones 184, 188 are fully isolated from each other, as well as the upper and lower portions of the well. With the first and second zones 184, 188 isolated, the service washpipe (e.g., feature 302 in FIG. 3) and service tool may be fully pulled uphole, leaving the lower completion assembly 170 intact downhole. As this stage, an upper completion assembly (not shown) may be run downhole, and one or both of the sliding sleeves may be opened (e.g., mechanically or hydraulically opened), thus opening one or both of the first and second zones 184, 188 for production.

In accordance with this disclosure, the lower completion assembly 170 acts as a single trip two zone gravel pack lower completion assembly. Accordingly, the lower completion assembly provides many advantages over existing tools and methods, including in one embodiment compartmentalizing two section of a wellbore with an hydraulic set packer, achieving gravel pack of the two zones on a single run using shunt tubes for diversion, running an integrated selectivity string in the same run, maintaining pressure maintenance during the whole operation, isolating the well when running the upper completion, and the ability of a selective production through smart well upper completion. Thus, according to one embodiment of the disclosure, at least one trip in hole to set the intermediate completion assembly is saved. Moreover, according to one embodiment of the disclosure, the overall cost for the installation is significantly reduced, as the time for running and operating the lower completion assembly is condensed.

While FIG. 1 has illustrated an embodiment wherein the lower completion assembly 170 is located within a cased hole portion and an open hole portion of a wellbore, those skilled in the art understand that other applications are within the scope of the disclosure. For example, the lower completion assembly 170 could be fully located within a cased hole portion of the wellbore, or in an alternative embodiment fully located within an open hole portion of the wellbore. Accordingly, unless otherwise detailed, the present disclosure should not be limited strictly to a closed hole application or open hole application.

Even though FIG. 1 depicts a vertical well, it should be noted by one skilled in the art that a lower completion assembly of the present disclosure is equally well-suited for use in deviated wells, inclined wells or horizontal wells. In fact, a lower completion assembly according to the disclosure is particularly useful in horizontal applications. Also, even though FIG. 1 depicts an offshore operation, those skilled in the art understand that the principles of the present disclosure are equally as applicable in other subterranean formations, including those encompassing both areas below exposed earth and areas below earth covered by water such as ocean or fresh water.

Turning to FIGS. 2A and 2B, as well as the enlarged views of FIGS. 2C-2G, illustrated is one embodiment of a lower completion assembly 200 as might remain within an cased hole portion 299*a* (e.g., uphole portion) and an open hole portion 299*b* (e.g., downhole portion) of a wellbore 299 after a dual zone gravel pack process has been completed. Again, the present disclosure is not limited to a combination of open hole and closed hole applications, but nevertheless the embodiment of the following FIGS. is discussed as such. Accordingly, references to open hole may actually reference downhole, and references to cased hole may actually reference uphole, and vice-versa. The lower completion assembly 200 in the illustrated embodiment includes (e.g., moving from a downhole to an uphole end of the lower completion assembly 200) a washdown assembly 210 (e.g., an enlarged portion of which is shown in FIG. 2C), a lower shunt screen assembly 220 (e.g., an enlarged portion of which is shown in FIG. 2D), an open hole packer assembly 230 (e.g., an enlarged portion of which is shown in FIG. 2E), an upper shunt screen assembly 240 (e.g., an enlarged portion of which is shown in FIG. 2F), an annular isolation flow assembly 250 (e.g., an enlarged portion of which is shown in FIG. 2G) and a gravel pack assembly 260. The lower completion assembly 200, additionally includes an inner string assembly 270 appropriately positioned within the aforementioned features.

In accordance with one embodiment of the disclosure, the washdown assembly 210 includes a washdown jet shoe 212 positioned at a downhole end thereof. The washdown assembly 210 additionally includes a remote actuated isolation valve 214, which may be an eRed type valve in one particular embodiment. Positioned uphole of the remote actuated isolation valve 214 may be a washdown assembly seal bore 216. In accordance with one embodiment, the washdown assembly seal bore 216 is a 4.00" ID—L80 13Cr seal bore. The washdown assembly 210 illustrated in FIGS. 2B and 2C additionally includes a pup joint 218 (e.g., also commonly referred to as a short casing joint or tubing joint).

In accordance with one embodiment of the disclosure, the lower shunt screen assembly 220 includes one or more shunt screens 222. In addition to the shunt screens 222, the lower shunt screen assembly 220 may have one or more blanks (not shown). When used, the blanks could be uphole of the shunt screens 222, and could be used for a typical screen out process. In addition to the above, the lower shunt screen assembly 220 could include a lower shunt tube 224.

In accordance with one embodiment of the disclosure, the open hole packer assembly 230 includes a lower open hole packer seal bore 232. Additionally, the open hole packer assembly 230 may include an open hole packer 234. The open hole packer 234, in one embodiment, is a hydraulically actuated open hole packer. The open hole packer 234, in one embodiment, may additionally include a shunt feed through tube (not shown). The shunt feed through tube, in accordance with this disclosure, is configured to pass gravel pack slurry downhole to the shunt screens 222 after the open hole packer 234 has been set. The open hole packer assembly 230 additionally includes an upper open hole packer seal bore 236.

In accordance with one embodiment of the disclosure, the upper shunt screen assembly 240 may include one or more shunt screens 242. In addition to the shunt screens 242, the upper shunt screen assembly 240 may have one or more blanks (not shown). When used, the blanks could be uphole of the shunt screens 242, and could be used for a typical screen out process. The upper shunt screen assembly 240 additionally includes one or more upper shunt tubes 244. The upper shunt screen assembly 240, in one embodiment, additionally includes a shunt tube entry sub 245. The shunt tube entry sub 245 is open to the wellbore, and fluidically coupled to the shunt feed through tube of the open hole packer assembly 230 (e.g., via the shunt tube 244), and thus ultimately to the shunt tube 224 of the lower shunt screen assembly 220. The upper shunt screen assembly 240 additionally includes blank pipe 246, as well as an upper makeup sub 248. The upper makeup sub 248, in one embodiment, is a quick connect makeup sub.

The annular isolation flow assembly 250, in accordance with the embodiment illustrated, may include a corresponding lower makeup sub 252 (e.g., that corresponds with the upper makeup sub 248 of the upper shunt screen assembly 240), which may also be a quick connect makeup sub. The annular isolation flow assembly 250 may additionally include an annular isolation flow sub 254, as well as another upper makeup sub 256. Similar to the others, the upper makeup sub 256 may be a quick connect makeup sub.

In the illustrated embodiment, the gravel pack assembly 260 includes a plurality of different features. For example, the gravel pack assembly 260 includes a corresponding lower makeup sub 261, which may again be a quick connect makeup sub. The gravel pack assembly 260 may additionally include a plurality of extensions 262 separating the various different features of the gravel pack assembly 260. For example, a pair of extensions 262 could separate, a sand control service tool positioning nipple 263, a sand control service tool nipple 264, and a closing sleeve/circulating sub 265. The gravel pack assembly 260 of FIG. 2A additionally includes an upper sand control service tool nipple 266, and a packer connector sub 267. Additionally, the gravel pack assembly 260 includes the cased hole packer 268. The cased hole packer 268, in the illustrated embodiment, is a hydraulically actuated cased hole packer.

In accordance with one embodiment of the disclosure, an inner string assembly 270 is positioned within the aforementioned assemblies 210, 220, 230, 240, 250. The inner string assembly 270 in the illustrated embodiment includes (e.g., moving from a downhole to an uphole end thereof) a seal assembly 272, a tubing spacer pipe 274, seal bore 276 with optional lock profile, isolation plug 277 located within the seal bore 276, a tubing spacer pipe adapter 278, a sliding sleeve 280, another tubing spacer pipe 282, a hydraulically operated sliding sleeve 284, another tubing spacer pipe 286, a seal assembly 288, another tubing spacer pipe 290, a seal assembly 292, a sliding sleeve 294, another tubing spacer pipe 296, and an annular isolation flow sub 298. While many features of the inner string assembly 270 have been illustrated in the embodiment of FIGS. 2A and 2B, those skilled in the art understand that the inner string assembly 270 may, in certain embodiments, include other features that those listed above.

One embodiment of a process for configuring and deploying the lower completion assembly 200 is now discussed. The features of the lower completion assembly 200 will typically be installed at the deck of an oil/gas platform, for example using a hoisting apparatus, rotary table, and derrick. In a first configuration step, the washdown assembly 210, the lower shunt screen assembly 220, the open hole packer assembly 230, and the upper shunt screen assembly 240 are coupled together, and allowed to hang toward the downhole end of the wellbore 299. In certain embodiments, the length of these components is greater than the distance between the oil/gas platform and the wellbore, and thus these components hang at least partially within the wellbore.

The washdown assembly 210, the lower shunt screen assembly 220, the open hole packer assembly 230, and the upper shunt screen assembly 240 may be coupled together into a variety of sub-assemblies, as well as at the rig location or elsewhere. In one embodiment, however, said features are coupled together at the rig location, and begin with the downhole most feature. Thus, in accordance with this embodiment, the washdown assembly 210 could be held by the rotary table as the hoisting apparatus lowers the lower shunt screen assembly 220 thereon, wherein the two are coupled to one another. Thereafter, the lower shunt screen assembly 220 could be held by the rotary table as the hoisting apparatus lowers the open hole packer assembly 230 thereon, wherein the two are coupled to one another. Thereafter, the open hole packer assembly 230 could be held by the rotary table as the hoisting apparatus lowers the upper shunt screen assembly 240 thereon, wherein the two are coupled to one another. At this stage, the washdown assembly 210, the lower shunt screen assembly 220, the open hole packer assembly 230, and the upper shunt screen assembly 240 would be coupled together and hanging from the rig floor as a single outer unit.

With the washdown assembly 210, the lower shunt screen assembly 220, the open hole packer assembly 230, and the upper shunt screen assembly 240 coupled to one another as a single outer unit and hanging from the rig floor, the inner string assembly 270 features could be coupled to one another using a process similar to that used with the previous outer components, and thereby lowered within an interior of the single outer unit. Accordingly, the inner string assembly 270 would be designed and installed, such that its features are appropriately aligned with the associated features of the single outer unit. Thus, as an example, each of the seal assemblies of the inner string assembly 270 would align with associated seal bores of the washdown assembly 210, lower shunt screen assembly 220, open hole packer assembly 230, and the upper shunt screen assembly 240. Other features of the inner string assembly 270 would align with other related features of the washdown assembly 210, lower shunt screen assembly 220, open hole packer assembly 230, and the upper shunt screen assembly 240, as well.

At this stage, the top most portion of the inner string assembly 270 and the upper makeup sub 248 of the upper shunt screen assembly 240 would be held within the rotary table. Thereafter, the annular isolation flow assembly 250 could be coupled to the exposed features. For example, the annular isolation flow assembly 250 couple be lowered toward the exposed features, wherein the annular isolation flow sub 254 of the annular isolation flow assembly 250 could be coupled to the annular isolation flow sub 298 of the inner string assembly 270. With these two subs coupled, the lower makeup sub 252 of the annular isolation flow assembly 250 and the upper makeup sub 248 of the upper shunt screen assembly 240 could come together, and thereafter be coupled to one another using an associated quick connection, among other suitable connections.

Turning briefly to FIG. 3, illustrated is a gravel pack service tool assembly 300 manufactured and designed according to the present disclosure. The gravel pack service tool assembly 300, in the illustrated embodiment, includes (e.g., moving from a downhole to an uphole end thereof) a washpipe 302, an adapter 305, a lower weight down collect indicator 310, a handling sub 315, a swivel 320, a reverse out check tool 325, a seal mandrel 330, a hydrostatic plug/weldment/housing seal receptacle 335, a seal mandrel 340, a connecting sub/flow diverter valve 345, service tool lugs 350, a gravel pack service tool 355, and a pup joint 360. While the gravel pack service tool assembly 300 has been illustrated as having the above features, those skilled in the art understand that variations from the above are within the scope of the disclosure.

Returning back to the process for configuring and deploying the lower completion assembly 200, the gravel pack service tool assembly 300 may be coupled to, and within, the gravel pack assembly 260, such as shown in FIG. 3. Thereafter, the gravel pack assembly 260 having the gravel pack service tool assembly 300 therein may be attached to the above assembly. For example, the adapter 305 of the gravel pack service tool assembly 300 could couple to the inner string assembly 270, and the lower makeup sub 261 of the gravel pack assembly 260 could couple to the upper makeup sub 256 of the annular isolation flow assembly 250, for example using a quick connect connection.

At this stage, the entire assembly, for example including the washdown assembly 210, the lower shunt screen assembly 220, the open hole packer assembly 230, the upper shunt screen assembly 240 the annular isolation flow assembly 250, and the gravel pack assembly 260, as well as the inner string assembly 270 and gravel pack service tool assembly 300 positioned therein, may be deployed downhole and run to depth. For example, the entire apparatus could be deployed downhole until the washdown jet shoe 212 of the washdown assembly 210 is within a prescribed distance (e.g., 1 to 5 meters) from the bottom of the open hole portion 299*b*, or at the bottom in certain applications. Those skilled in the art understand the process for deploying the entire apparatus, including using drill pipe and the drill rig to do the same.

With the entire apparatus in place, the gravel pack process may begin. The gravel pack process begins, in one embodiment, with a first step by running the entire apparatus in hole, setting the various packers, and gravel packing the first and second zones. For example, this first step could include running the entire apparatus to the total depth, and then dropping a setting ball therein. The setting ball could engage a feature in the gravel pack service tool assembly 300, for example near an upper end of the gravel pack service tool 355. With the setting ball in place, the tool could be pressured up to set the cased hole packer 268. Thereafter, the tool could be pressured up again (e.g., to a second greater pressure) to release the service tool lugs 350, and thus allow the gravel pack service tool assembly 300 to move within the lower completion assembly 200.

At this stage, with the gravel pack service tool assembly 300 able to move, the remote actuated isolation valve 214 could be closed, and the tool could be pressured up again to set the open hole packer 234. The remote actuated isolation valve 214 could then be triggered again to close (e.g., locked closed in one embodiment). The remote actuated isolation valve 214 can be triggered between the open and closed positions using a variety of different mechanisms, including based upon time, pressure, a signal, etc.

At this stage, the gravel pack service tool assembly 300 may be moved uphole to a test position to test the integrity of the cased hole packer 268. Once the integrity of the packer has been tested, the gravel pack service tool assembly 300 may be placed in a weight down position on the cased hole packer 268, and the gravel pack process begins. The gravel pack process consists of pumping the gravel slurry down the tool until the top zone screens out, and then the gravel slurry moves into the shunt tube entry sub 245 and through the shunt tube 244, past the open hole packer 234 via the shunt feed through, and into the shunt tube 244 before packing the lower screens and screening out the lower zone.

At this stage, a reverse out process can be conducted, for example to remove the excess gravel slurry in the drill pipe. The reverse out process may include picking up the gravel pack service tool assembly 300 and pumping down the annulus via a port in the gravel pack service tool assembly 300, thereby removing the excess slurry. The gravel pack process is now complete.

Next, a second step may be conducted to isolate the upper and lower zones, for example from each other and the wellbore. This second step may include pulling the gravel pack service tool assembly 300 and washpipe 302 out of the hole a distance such that the isolation plug 277 of the inner string assembly locks within the seal bore 266. For example, in the run in hole position, the isolation plug 277 formed part of the inner string assembly 280 that was positioned below the seal bore 266. However, when the gravel pack service tool assembly 300 is pulled out of hole the isolation plug 277 shifts uphole as shown in FIGS. 2B and 2C, and catches in the seal bore 276. With enough upward pressure on the gravel pack service tool assembly 300, the isolation plug 277 shears off, and thus remains as shown in FIG. 2B.

With the isolation plug 277 set, the gravel pack service tool assembly 300 may be pulled further uphole, and the lower sliding sleeves 280, 284 may be closed. Thereafter, the gravel pack service tool assembly 300 may be pulled further uphole and the upper sliding sleeve 294 may be closed. At this stage, both of the zones are isolated from one another and the wellbore, all of which is conducted by pulling the gravel pack service tool assembly 300 uphole. With the upper and lower zones fully isolated, the drill pipe and gravel pack service tool assembly 300 may be pulled entirely out of hole, leaving the lower completion assembly 200 illustrated in FIGS. 2A and 2B.

At this stage, the step of running the upper completion and opening the upper and lower zones for production may commence. This step may include running a smart upper completion, opening the lower zone by opening the hydraulically operated sliding sleeve 284, and opening the upper zone by cycling the tool to open the sliding sleeve 294. With the upper and lower zones open, the production of said zones can commence.

Aspects disclosed herein include:

A. A method for gravel packing dual zones within a wellbore, comprising: 1) creating an outer sub-assembly consisting of a washdown assembly, a lower shunt screen assembly, a downhole packer assembly, an upper shunt screen assembly, and a gravel pack assembly stacked in order on top of one another; 2) creating an inner sub-assembly consisting of an inner string assembly and gravel pack service tool assembly stacked in order on top of one another, wherein the inner sub-assembly is positioned within the outer sub-assembly; 3) running the outer sub-assembly having the inner sub-assembly therein proximate a bottom of a downhole portion of a wellbore; 4) setting an uphole packer associated with the gravel pack assembly in an uphole portion of the wellbore and a downhole packer associated with the downhole packer assembly in the downhole portion of the wellbore; 5) gravel packing an upper zone of the uphole portion of the wellbore using the upper shunt screen assembly and a lower zone of the downhole portion of the wellbore using the lower shunt screen assembly; 6) pulling the gravel pack service tool assembly out of the wellbore thereby isolating the upper zone and the lower zone from each other and the wellbore; and 7) running an upper completion into the wellbore to open one or both of the upper zone or the lower zone for production.

B. A lower completion assembly for use in gravel packing dual zones within a wellbore, comprising: an outer sub assembly, including; 1) a washdown assembly; 2) a lower shunt screen assembly coupled uphole of the washdown assembly and configured to be associated with a lower zone in a wellbore; 3) a downhole packer assembly coupled uphole of the lower shunt screen assembly; 4) an upper shunt screen assembly coupled uphole of the downhole packer assembly and configured to be associated with an upper zone in the wellbore; 5) a gravel pack assembly stacked uphole of the upper shunt screen assembly; as well as an inner sub-assembly positioned within the outer sub-assembly, the inner sub-assembly including an inner string assembly spanning the washdown assembly to the gravel pack assembly.

Aspects A and B may have one or more of the following additional elements in combination:

Element 1: wherein pulling the gravel pack tool assembly out of the wellbore thereby isolating the upper zone and the lower zone from each other and the wellbore, includes setting an isolation plug associated with the inner string assembly in a seal bore associated with the washdown assembly. Element 2: wherein pulling the gravel pack tool assembly out of the wellbore thereby isolating the upper zone and the lower zone from each other and the wellbore, additionally includes closing a mechanical sliding sleeve and a hydraulic sliding sleeve associated with the lower shunt screen assembly, and a sliding sleeve associated with the upper shunt screen assembly, and then pulling the gravel pack tool assembly entirely out of the wellbore. Element 3: wherein running an upper completion into the wellbore to open the upper zone and the lower zone for production, includes opening the hydraulic sliding sleeve associated with the lower shunt screen assembly and the sliding sleeve associated with the upper shunt screen assembly. Element 4: wherein opening the hydraulic sliding sleeve includes opening the hydraulic sliding sleeve using hydraulic pressure, and wherein opening the sliding sleeve associated with the upper screen assembly includes cycling an annular isolation flow sub associated with the gravel pack assembly. Element 5: wherein setting an uphole packer associated with the gravel pack assembly in an uphole portion of the wellbore includes dropping a setting ball within the gravel pack assembly and pressuring up to set the uphole hole packer. Element 6: wherein setting a downhole packer associated with the downhole packer assembly in the downhole portion of the wellbore includes closing a remote actuated isolation valve of the washdown assembly. Element 7: wherein setting a downhole packer associated with the downhole packer assembly further includes pressuring up to set the downhole packer while the remote actuated isolation valve is in the closed position. Element 8: wherein setting a downhole packer associated with the downhole packer assembly further includes opening the remote actuated isolation valve after setting the downhole packer whereby the applied pressure represents a suitable signal to activate an isolation plug. Element 9: wherein gravel packing an upper zone of the downhole portion of the wellbore using the upper shunt screen assembly and a lower zone of the downhole portion of the wellbore using the lower shunt screen assembly and includes moving the gravel pack service tool assembly to a weight down position on the gravel pack assembly. Element 10: wherein gravel packing an upper zone of the downhole portion of the wellbore using the upper shunt screen assembly and a lower zone of the downhole portion of the wellbore using the lower shunt screen assembly further includes screening out the upper zone after moving the gravel pack service tool assembly to the weight down position. Element 11: wherein gravel packing an upper zone of the downhole portion of the wellbore using the upper shunt screen assembly and a lower zone of the downhole portion of the wellbore using the lower shunt screen assembly further includes screening out the lower zone after screening out the upper zone. Element 12: wherein gravel packing an upper zone of the downhole portion of the wellbore using the upper shunt screen assembly and a lower zone of the downhole portion of the wellbore using the lower shunt screen assembly further includes reversing out to remove excess gravel slurry from the wellbore. Element 13: wherein the washdown assembly includes a washdown jet shoe, a remote actuated isolation valve, a washdown assembly seal bore, and a pup joint. Element 14: wherein the lower shunt screen assembly includes one or more shunt screens and a lower shunt tube. Element 15: wherein the downhole packer includes a lower downhole packer seal bore, a downhole packer, a shunt feed through tube, and an upper downhole packer seal bore. Element 16: wherein the upper shunt screen assembly includes one or more shunt screens, one or more shunt tubes, a shunt tube entry sub, blank pipe and an upper makeup sub. Element 17: wherein the annular isolation flow assembly includes a lower makeup sub, an annular isolation flow sub, and an upper makeup sub. Element 18: wherein the gravel pack assembly includes a lower makeup sub, a packer connector sub, and an uphole packer.

Those skilled in the art to which this application relates will appreciate that other and further additions, deletions, substitutions and modifications may be made to the described embodiments.

What is claimed is:

1. A method for gravel packing dual zones within a wellbore, comprising:

creating an outer sub-assembly consisting of a washdown assembly, a lower shunt screen assembly, a downhole packer assembly, an upper shunt screen assembly, and a gravel pack assembly stacked in order on top of one another;

creating an inner sub-assembly consisting of an inner string assembly and gravel pack service tool assembly stacked in order on top of one another, wherein the inner sub-assembly is positioned within the outer sub-assembly;

running the outer sub-assembly having the inner sub-assembly therein proximate a bottom of a downhole portion of a wellbore;

setting an uphole packer associated with the gravel pack assembly in an uphole portion of the wellbore and a downhole packer associated with the downhole packer assembly in the downhole portion of the wellbore;

gravel packing an upper zone of the uphole portion of the wellbore using the upper shunt screen assembly and a lower zone of the downhole portion of the wellbore using the lower shunt screen assembly;

pulling the gravel pack service tool assembly out of the gravel pack assembly of the outer-sub assembly and the inner string assembly of the inner sub-assembly, thereby leaving the gravel pack assembly and inner string assembly downhole to isolate the upper zone and the lower zone from each other and the wellbore; and running an upper completion into the wellbore to open one or both of the upper zone or the lower zone for production.

2. The method as recited in claim 1, wherein pulling the gravel pack service tool assembly out of the wellbore thereby isolating the upper zone and the lower zone from each other and the wellbore, includes setting an isolation plug associated with the inner string assembly in a seal bore associated with the washdown assembly.

3. The method as recited in claim 2, wherein pulling the gravel pack tool assembly out of the wellbore thereby isolating the upper zone and the lower zone from each other and the wellbore, additionally includes closing a mechanical sliding sleeve and a hydraulic sliding sleeve associated with the lower shunt screen assembly, and a sliding sleeve associated with the upper shunt screen assembly, and then pulling the gravel pack tool assembly entirely out of the wellbore.

4. The method as recited in claim 3, wherein running an upper completion into the wellbore to open the upper zone and the lower zone for production, includes opening the hydraulic sliding sleeve associated with the lower shunt screen assembly and the sliding sleeve associated with the upper shunt screen assembly.

5. The method as recited in claim 4, wherein opening the hydraulic sliding sleeve includes opening the hydraulic sliding sleeve using hydraulic pressure, and wherein opening the sliding sleeve associated with the upper screen assembly includes cycling an annular isolation flow sub associated with the gravel pack assembly.

6. The method as recited in claim 1, wherein setting the uphole packer associated with the gravel pack assembly in the uphole portion of the wellbore includes dropping a setting ball within the gravel pack assembly and pressuring up to set the uphole hole packer.

7. The method as recited in claim 6, wherein setting a downhole packer associated with the downhole packer assembly in the downhole portion of the wellbore includes closing a remote actuated isolation valve of the washdown assembly.

8. The method as recited in claim 7, wherein setting a downhole packer associated with the downhole packer assembly further includes pressuring up to set the downhole packer while the remote actuated isolation valve is in the closed position.

9. The method as recited in claim 8, wherein setting a downhole packer associated with the downhole packer assembly further includes opening the remote actuated isolation valve after setting the downhole packer whereby the applied pressure represents a suitable signal to activate an isolation plug.

10. The method as recited in claim 1, wherein gravel packing an upper zone of the downhole portion of the wellbore using the upper shunt screen assembly and a lower zone of the downhole portion of the wellbore using the lower shunt screen assembly and includes moving the gravel pack service tool assembly to a weight down position on the gravel pack assembly.

11. The method as recited in claim 10, wherein gravel packing an upper zone of the downhole portion of the wellbore using the upper shunt screen assembly and a lower zone of the downhole portion of the wellbore using the lower shunt screen assembly further includes screening out the upper zone after moving the gravel pack service tool assembly to the weight down position.

12. The method as recited in claim 11, wherein gravel packing an upper zone of the downhole portion of the wellbore using the upper shunt screen assembly and a lower zone of the downhole portion of the wellbore using the lower shunt screen assembly further includes screening out the lower zone after screening out the upper zone.

13. The method as recited in claim 12, wherein gravel packing an upper zone of the downhole portion of the wellbore using the upper shunt screen assembly and a lower zone of the downhole portion of the wellbore using the lower shunt screen assembly further includes reversing out to remove excess gravel slurry from the wellbore.

14. A lower completion assembly for use in gravel packing dual zones within a wellbore, comprising:

an outer sub assembly, including;

a washdown assembly;

a lower shunt screen assembly coupled uphole of the washdown assembly and configured to be associated with a lower zone in a wellbore;

a downhole packer assembly coupled uphole of the lower shunt screen assembly;

an upper shunt screen assembly coupled uphole of the downhole packer assembly and configured to be associated with an upper zone in the wellbore;

a gravel pack assembly stacked uphole of the upper shunt screen assembly; and an inner sub-assembly positioned within the outer sub-assembly, the inner sub-assembly including an inner string assembly spanning the washdown assembly to the gravel pack assembly and a gravel pack service tool assembly positioned over the inner string assembly, wherein the gravel pack service tool assembly is operable to be pulled out of the inner string assembly leaving the inner string assembly and the outer sub-assembly downhole to isolate the upper zone and the lower zone from each other and the wellbore.

15. The lower completion assembly of claim 14, wherein the washdown assembly includes a washdown jet shoe, a remote actuated isolation valve, a washdown assembly seal bore, and a pup joint.

16. The lower completion assembly of claim 14, wherein the lower shunt screen assembly includes one or more shunt screens and a lower shunt tube.

17. The lower completion assembly of claim 14, wherein the downhole packer includes a lower downhole packer seal bore, a downhole packer, a shunt feed through tube, and an upper downhole packer seal bore.

18. The lower completion assembly of claim 14, wherein the upper shunt screen assembly includes one or more shunt screens, one or more shunt tubes, a shunt tube entry sub, blank pipe and an upper makeup sub.

19. The lower completion assembly of claim 14, further including an annular isolation flow assembly associated with the gravel pack assembly, wherein the annular isolation flow assembly includes a lower makeup sub, an annular isolation flow sub, and an upper makeup sub.

20. The lower completion assembly of claim 14, wherein the gravel pack assembly includes a lower makeup sub, a packer connector sub, and an uphole packer.

* * * * *